US009783386B2

(12) United States Patent
Ito

(10) Patent No.: US 9,783,386 B2
(45) Date of Patent: Oct. 10, 2017

(54) SHEET CONVEYING APPARATUS

(71) Applicant: BROTHER KOGYO KABUSHIKI KAISHA, Nagoya-shi, Aichi-ken (JP)

(72) Inventor: Tetsuo Ito, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/978,076

(22) Filed: Dec. 22, 2015

(65) Prior Publication Data

US 2016/0185551 A1 Jun. 30, 2016

(30) Foreign Application Priority Data

Dec. 26, 2014 (JP) ..... 2014-264948

(51) Int. Cl.

| | |
|---|---|
| ***B65H 29/54*** | (2006.01) |
| ***B65H 29/14*** | (2006.01) |
| ***B65H 31/02*** | (2006.01) |
| ***B65H 31/26*** | (2006.01) |
| *B65H 31/14* | (2006.01) |
| *B65H 31/12* | (2006.01) |

(52) U.S. Cl.

CPC ..... *B65H 29/14* (2013.01); *B65H 31/02* (2013.01); *B65H 31/26* (2013.01); *B65H 31/12* (2013.01); *B65H 31/14* (2013.01); *B65H 2301/4212* (2013.01); *B65H 2301/51214* (2013.01); *B65H 2405/1144* (2013.01); *B65H 2405/11161* (2013.01); *B65H 2405/3321* (2013.01); *B65H 2515/81* (2013.01); *B65H 2801/06* (2013.01); *B65H 2801/39* (2013.01)

(58) Field of Classification Search

CPC ..... B65H 31/14; B65H 31/38; B65H 31/00; B65H 31/12; B65H 2405/1144

See application file for complete search history.

(56) References Cited

U.S. PATENT DOCUMENTS

| | | | | |
|---|---|---|---|---|
| 4,993,697 A | | 2/1991 | Yamashita et al. | |
| 5,280,897 A | * | 1/1994 | Maekawa | G03G 15/234 271/207 |
| 5,963,754 A | * | 10/1999 | Itoh | B65H 29/14 271/258.01 |

(Continued)

FOREIGN PATENT DOCUMENTS

| | | |
|---|---|---|
| JP | 1-214576 A | 8/1989 |
| JP | 7-242362 A | 9/1995 |

*Primary Examiner* — Howard Sanders

(74) *Attorney, Agent, or Firm* — Merchant & Gould P.C.

(57) ABSTRACT

A sheet conveying apparatus includes: a conveyor configured to convey a sheet along a conveyance path; and a discharge tray having a support surface for supporting the sheet discharged from the conveyor. The conveyor includes a discharge unit for discharging the sheet conveyed along the conveyance path, onto the discharge tray. The discharge tray is provided with a projection protruding upward from the support surface and elongated in a direction along a discharge direction in which the sheet is conveyed. At least a portion of the projection which has a downstream edge of the projection in the discharge direction is a movable portion changeable between a first position at which an upper end portion of the projection is farthest from the support surface and a second position which is nearer to the support surface than the first position.

16 Claims, 11 Drawing Sheets

(56) References Cited

U.S. PATENT DOCUMENTS

| | | | | |
|---|---|---|---|---|
| 5,984,299 | A * | 11/1999 | Hirota | B65H 31/14<br>271/161 |
| 6,736,392 | B1 * | 5/2004 | Horiguchi | B65H 31/02<br>271/207 |
| 7,711,310 | B2 * | 5/2010 | Suzuki | G03G 15/00<br>271/161 |
| 7,748,705 | B2 * | 7/2010 | Yamada | B65H 31/02<br>271/209 |

* cited by examiner

UP
DOWN
LEFT
RIGHT
1
9
9C
SH
91
93
D1
92
92A
K1
81
81A
3
105
50
50S
X50
48
4
41
42
42A
43A
43
46
47
48A
48B
N1
X100
130
100
141
P1
45P
45
49
45G
45Q
82
82A
3S
5
8

SHEET CONVEYING APPARATUS

CROSS REFERENCE TO RELATED APPLICATION

The present application claims priority from Japanese Patent Application No. 2014-264948, which was filed on Dec. 26, 2014, the disclosure of which is herein incorporated by reference in its entirety.

BACKGROUND

Technical Field

The following disclosure relates to a sheet conveying apparatus.

Description of the Related Art

There is known a conventional sheet conveying apparatus including a conveying device and a discharge device. The conveying device conveys a sheet along a conveyance path in a device body. The discharge device constitutes a portion of the conveying device and discharges the sheet conveyed along the conveyance path, onto the discharge tray.

The discharge tray has a support surface for supporting a lower surface of the sheet. The support surface is provided with a projection. The projection protrudes to a position above the support surface and extends in a discharge direction in which the discharge device discharges the sheet.

In this sheet conveying apparatus, the projection raises a portion of the sheet being discharged onto the support surface to curve the sheet, resulting in increase in resilience of the sheet. This construction enables the discharge device to stably discharge the sheet onto the support surface.

SUMMARY

Incidentally, sheet conveying apparatuses are desired to convey sheets having different properties such as thin sheets which are easily bent and thick sheets which are not easily bent. In the above-described conventional sheet conveying apparatus, for example, the projection is formed on the support surface so as to match standard sheets. Thus, in the case where a thin easily-bent sheet is discharged onto the support surface, the sheet may be folded by collision with the projection. This case may cause malfunctions such as a crease in the sheet and generation of abnormal sounds when the sheet is folded. In the case where a thick not-easily-bent sheet is discharged onto the support surface, if the sheet is firmly rubbed against the projection, a large resistance force may act on the sheet during conveyance, unfortunately. This may cause malfunctions such as jam of the sheet due to hindrance to its discharge and generation of abnormal sounds due to friction between the sheet and the projection. That is, it is difficult for the sheet conveying apparatus of this kind to stably discharge sheets having different properties onto the discharge tray.

Accordingly, an aspect of the disclosure relates to a sheet conveying apparatus capable of stably discharging sheets having different properties onto a discharge tray.

In one aspect of the disclosure, a sheet conveying apparatus includes: a conveyor configured to convey a sheet along a conveyance path; and a discharge tray having a support surface configured to support the sheet discharged from the conveyor. The conveyor including a discharge unit constituting a portion of the conveyor and configured to discharge the sheet conveyed along the conveyance path, onto the discharge tray. The discharge tray has a projection protruding upward from the support surface, the projection being elongated in a direction along an output direction in which the sheet is conveyed by the conveyor. The projection has at least a portion having a downstream edge of the projection in the output direction, the at least the portion being a movable portion changeable in position between a first position at which an upper end portion of the projection is farthest from the support surface and a second position which is nearer to the support surface than the first position.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIG. 8A is a view for explaining the case where a thin easily-bent sheet is discharged, and FIG. 8B is a view for explaining the case where a thick not-easily-bent sheet is discharged;

DETAILED DESCRIPTION OF THE EMBODIMENTS

Hereinafter, there will be described first through fourth embodiments by reference to the drawings.

First Embodiment

Figure 1:
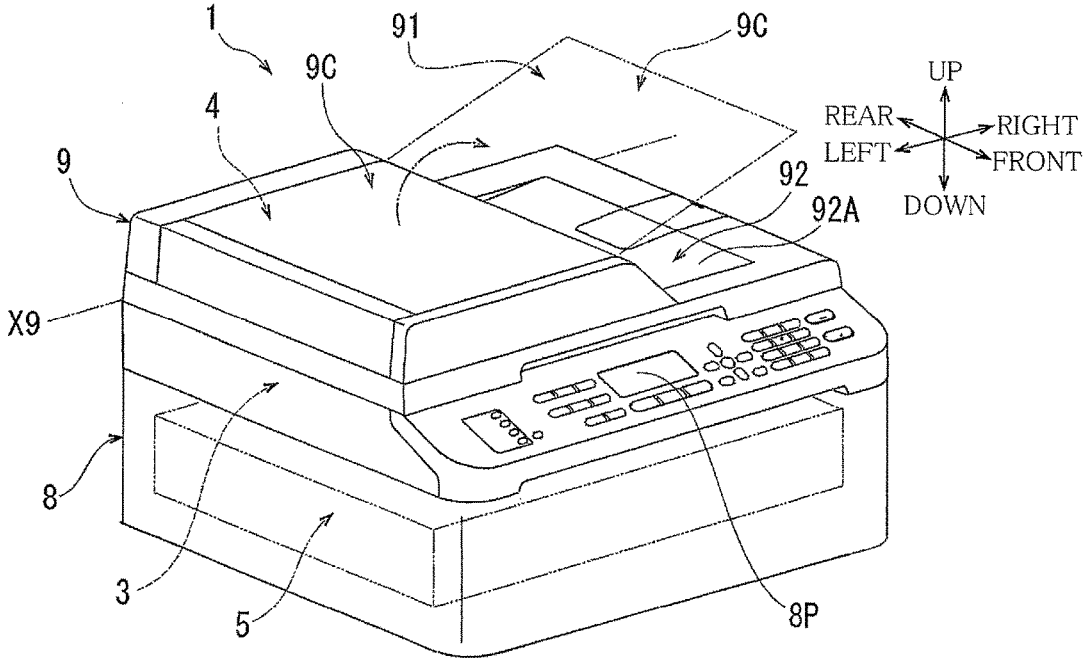
FIG. 1 is a perspective view of an image reading apparatus according to a first embodiment.

As illustrated in FIG. 1, an image reading apparatus 1 according to the first embodiment is one example of a sheet conveying apparatus. In the following description and drawings, a side on which an operation panel 8P is provided in FIG. 1 is defined as a front side of the image reading apparatus 1, and a left side when the image reading apparatus 1 is viewed from the front side is defined as a left side. A front and rear direction, a right and left direction, and an up and down direction are defined with respect to these sides.

Overall Construction

As illustrated in FIGS. 1-4, the image reading apparatus 1 includes a main body 8, an opening and closing member 9, an image forming unit 5, a reading unit 3, and a conveying device 4. The main body 8 is substantially shaped like a flat box. As illustrated in FIG. 1, a front surface of the main body 8 is provided with the operation panel 8P such as a touch-screen. The image forming unit 5 is accommodated in a lower portion of the main body 8. The image forming unit 5 performs ink-jet printing or laser printing, for example, to form an image on a sheet. The reading unit 3 is accommodated in an upper portion of the main body 8. The reading unit 3 reads an image recorded on a document. The conveying device 4 is provided in the opening and closing member 9. The conveying device 4 supplies sheets SH one by one from a supply tray 91 to a conveyance path P1 illustrated in FIG. 4 and conveys each sheet SH along the conveyance path P1 for the reading unit 3 to read an image recorded on the sheet SH.

Figure 4:
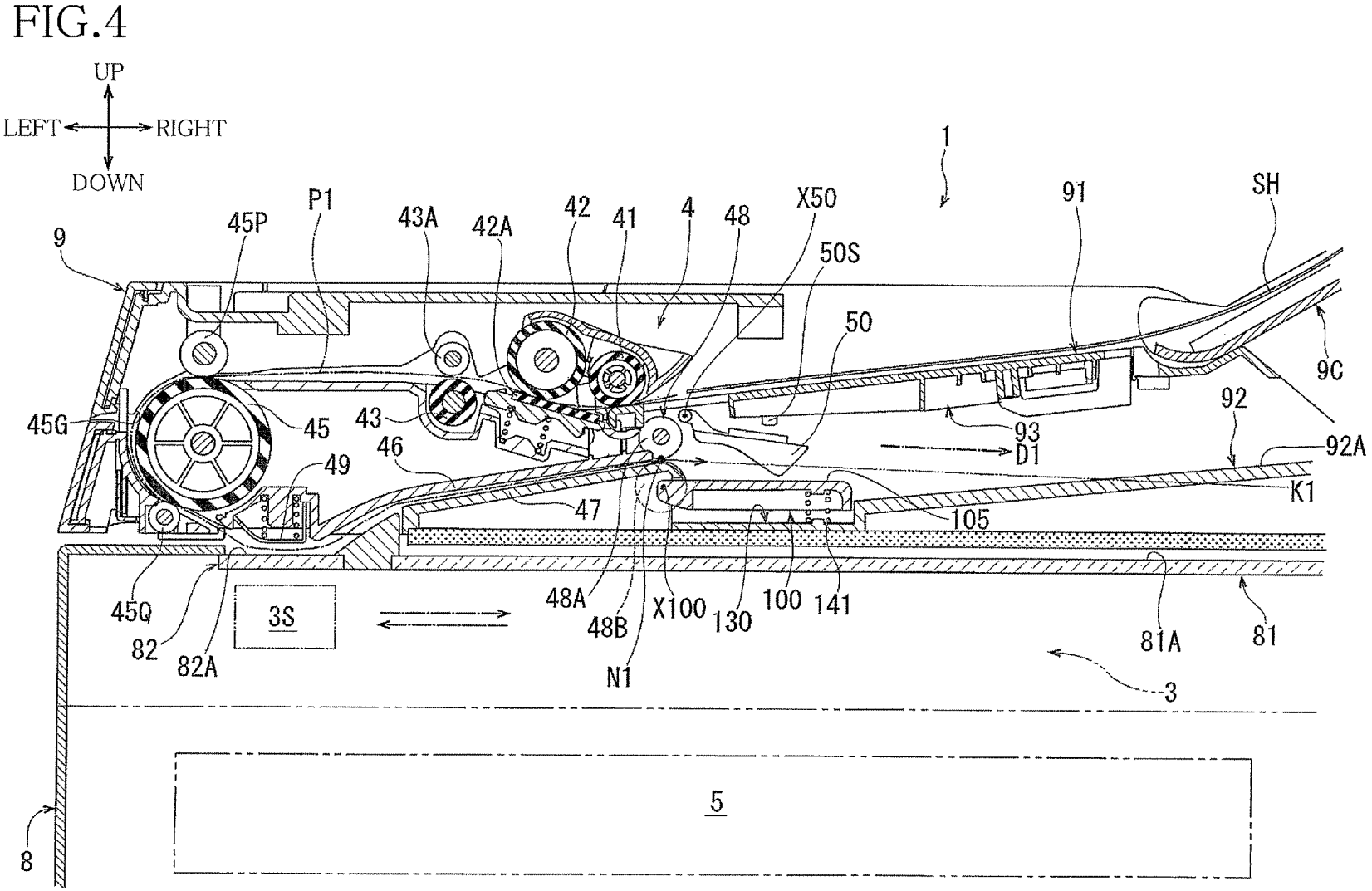
FIG. 4 is a partial cross-sectional view taken along line IV-IV in FIG. 2.

As illustrated in FIG. 4, a first platen glass 81 and a second platen glass 82 are disposed on an upper surface of the main body 8. An upper surface of the first platen glass 81 serves as a document support surface 81A. When the reading unit 3 reads an image recorded on a stationary document, the document support surface 81A supports a lower surface of the document. Examples of documents to be read include normal sheets, OHP sheets, and books. The second platen glass 82 is a narrow glass elongated in the front and rear direction and disposed to the left of the first platen glass 81. An upper surface of the second platen glass 82 serves as a reading surface 82A. When the reading unit 3 reads an image recorded on each sheet SH conveyed by the conveying device 4, the reading surface 82A guides a lower surface of the conveyed sheet SH. In the present embodiment, a subject of which image is to be read using the document support surface 81A will be referred to as "document", and a subject of which image is to be read during conveyance thereof by the conveying device 4 will be referred to as "sheet SH". The document and the sheet SH may be substantially the same as each other.

As illustrated in FIG. 1, the opening and closing member 9 is supported by hinges, not shown, arranged on an upper edge of a rear surface of the main body 8, such that the opening and closing member 9 is pivotable about an opening and closing axis X9 extending in the right and left direction. In a closed state illustrated in FIGS. 1-4, the opening and closing member 9 covers the document support surface 81A from above. Though not shown, the opening and closing member 9 is pivoted about the opening and closing axis X9 such that its front end portion is moved upward and rearward, so that the opening and closing member 9 is moved to its open position at which the document support surface 81A is exposed. This movement allows a user to place a document onto the document support surface 81A.

As illustrated in FIG. 4, the reading unit 3 includes a reading sensor 3S and a scanning mechanism, not shown. The reading sensor 3S is accommodated in the upper portion of the main body 8. The reading sensor 3S is one example of a reading device. The scanning mechanism reciprocates the reading sensor 3S in the main body 8 in the right and left direction within an area under the document support surface 81A and the reading surface 82A. When reading an image recorded on a document supported on the document support surface 81A, the reading sensor 3S reads the image while moving under the document support surface 81A. Under the reading surface 82A, the reading sensor 3S is stopped at a predetermined stationary reading position. When reading an image recorded on the sheet SH being conveyed by the conveying device 4, the reading sensor 3S is stopped at the stationary reading position. The reading sensor 3S is a well-known image reading sensor such as a contact image sensor (CIS) and a charge coupled device (CCD).

The conveying device 4 is provided in the opening and closing member 9 and includes the supply tray 91 and a discharge tray 92. The supply tray 91 is formed on a right portion of the opening and closing member 9 by opening a cover 9C from its closed position indicated by the solid line in FIG. 1 to a position indicated by the two-dot chain line in FIG. 1.

Figure 2:
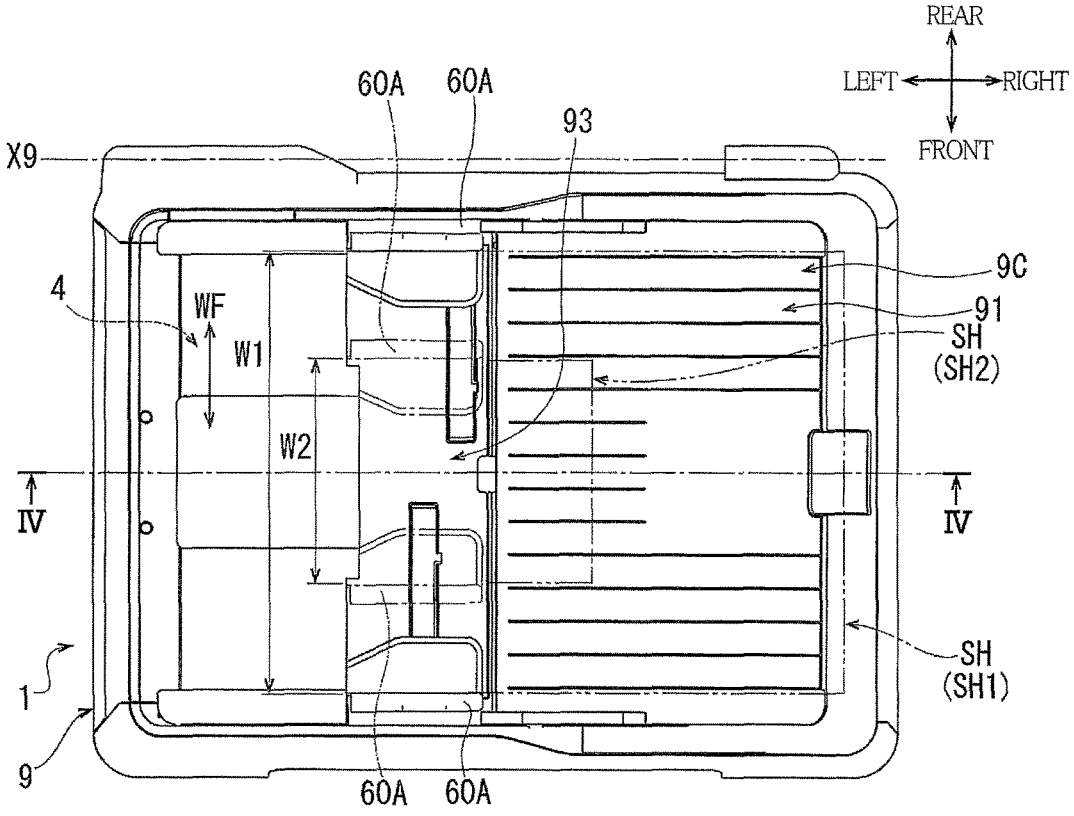
FIG. 2 is a top view of the image reading apparatus according to the first embodiment.
Figure 3:
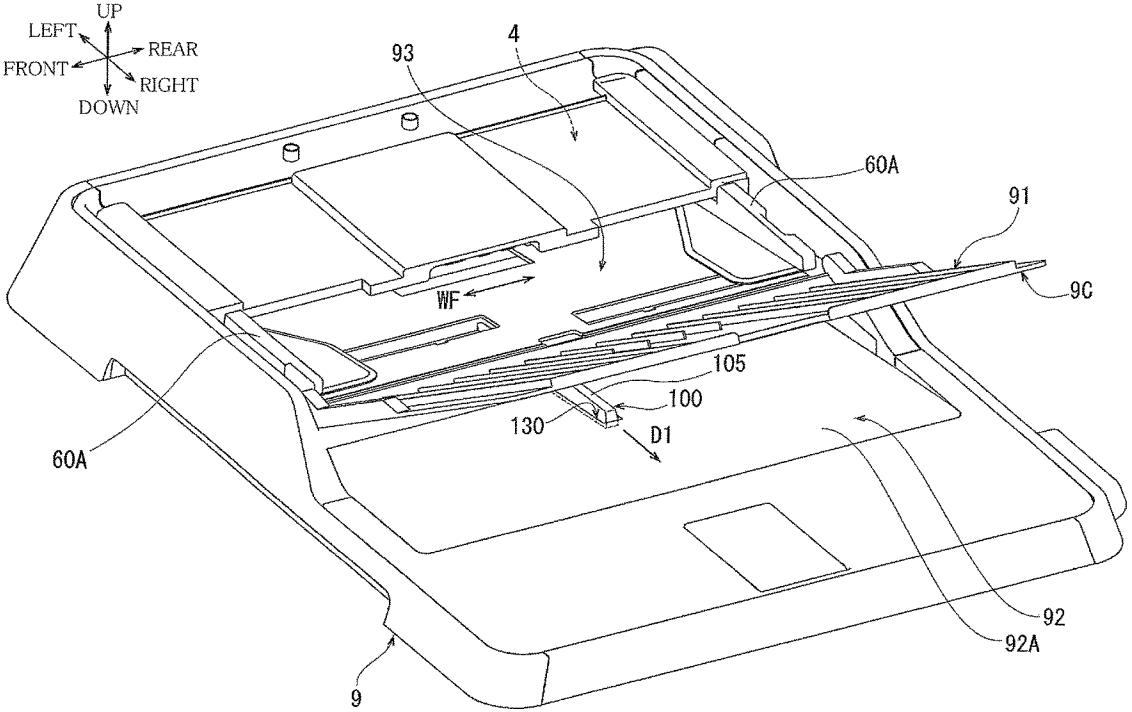
FIG. 3 is a perspective view illustrating a portion of the image reading apparatus according to the first embodiment.

As illustrated in FIGS. 2-4, the supply tray 91 is constituted by the cover 9C and a chute 93 provided to the left of the opened cover 9C. An upper surface of the supply tray 91 is a flat surface inclined so as to be lower at its left portion than at its right portion. The supply tray 91 is capable of supporting a lower surface of a lowermost one of a plurality of stacked sheets SH to be conveyed by the conveying device 4 for reading.

As illustrated in FIGS. 2 and 3, a pair of guides 60A, 60A slidable in the front and rear direction are provided on the chute 93 that is a portion of the supply tray 91. The pair of guides 60A, 60A are opposed to each other in the front and rear direction. The pair of guides 60A, 60A are coupled to each other by a rack and pinion mechanism, not shown. As indicated by the solid lines and the two-dot chain lines in FIG. 2, the pair of guides 60A, 60A are moved toward and away from each other so as to be brought into contact with front and rear edges of the sheets SH supported on the supply tray 91. The pair of guides 60A, 60A are capable of aligning various sizes of the sheets SH. Specifically, the pair of guides 60A, 60A are capable of positioning the sheets SH on the supply tray 91 in the front and rear direction with respect to the center of the supply tray 91. The front and rear direction in which the pair of guides 60A, 60A are slid may be hereinafter referred to as "widthwise direction WF".

In the present embodiment, large ones of various sizes of the sheets SH conveyable by the conveying device 4 are the A4 size and the letter size. Sheets of these sizes are defined as sheets SH1 of the large sizes. In the case where the large sheet SH1 is positioned on the supply tray 91, the pair of guides 60A, 60A indicated by the solid lines in FIG. 2 are spaced apart from each other in the front and rear direction at a distance equal to the length W1 of the large sheet SH1 in the widthwise direction WF, and the pair of guides 60A, 60A hold front and rear edges of the large sheet SH1.

In the present embodiment, the sheets SH conveyable by the conveying device 4 include sheets smaller in size than the large sheet SH1, such as sheets of the A6 size and the postcard size. The sheets of the A6 size and the postcard size are defined as small sheets SH2. In the case where the small sheet SH2 is positioned on the supply tray 91, the pair of guides 60A, 60A indicated by the two-dot chain lines in FIG. 2 are spaced apart from each other in the front and rear direction at a distance equal to the length W2 of the small sheet SH2 in the widthwise direction WF, and the pair of guides 60A, 60A hold front and rear edges of the small sheet SH2.

Though not shown, in the case where each of the sheets SH of sizes between the large sheet SH1 and the small sheet SH2 is positioned on the supply tray 91, the pair of guides 60A, 60A are spaced apart from each other in the front and rear direction at a distance equal to the length of the sheet in the widthwise direction WF, and the pair of guides 60A, 60A hold front and rear edges of the sheet SH.

As illustrated in FIGS. 3 and 4, the discharge tray 92 is disposed under the supply tray 91, and these trays 91, 92 overlap each other in the up and down direction. An upper surface of the discharge tray 92 serves as a support surface 92A. The sheets SH for which images are read by the reading sensor 3S and which are discharged by the conveying device 4 are stacked on the support surface 92A of the discharge tray 92. The support surface 92A is a flat surface inclined so as to be higher at its right portion than at its left portion. The support surface 92A is provided with a projection 100 which will be explained later in detail.

As illustrated in FIG. 4, the conveying device 4 defines the conveyance path P1 as a space surrounded by (i) guide surfaces extending in the opening and closing member 9 so as to be contactable respectively with one and the other surfaces of the sheet SH and (ii) conveying rollers which will be described below, and (iii) other components. The conveying device 4 conveys the sheet SH along the conveyance path P1. The conveyance path P1 first extends leftward from the supply tray 91 substantially in the horizontal direction. The conveyance path P1 curves downward, then extends rightward from the downward curved portion for short distance along the reading surface 82A, and finally extends to the discharge tray 92 while inclined upward to a right end of the conveyance path P1.

A conveying direction in which the sheet SH is conveyed by the conveying device 4 is the left direction in the upper substantially horizontal portion of the conveyance path P1. The conveying direction changes from the left direction to the right direction in the downward curved portion of the conveyance path P1. The conveying direction is the right direction in a portion of the conveyance path P1 which extends to the discharge tray 92 from a right end of the reading surface 82A defining the conveyance path P1 from below. It is noted that the shape of the conveyance path P1 and the direction in which the conveyance path P1 extends are one example.

The conveying device 4 includes a supply roller 41, a separating roller 42, and a separating pad 42A at a portion of the conveyance path P1 near the supply tray 91. The supply roller 41 supplies the sheet SH supported on the supply tray 91, to the separating roller 42 located downstream of the supply roller 41 in the conveying direction. The separating roller 42 cooperates with the separating pad 42A to separate overlapping sheets SH one by one to convey each sheet SH to a downstream side of the separating roller 42 in the conveying direction.

The conveying device 4 includes a pair of conveying rollers 43, 43A disposed downstream of the separating roller 42 and the separating pad 42A in the conveying direction. The pair of conveying rollers 43, 43A convey the sheets SH separated one by one by the separating roller 42 and the separating pad 42A, to a downstream side of the pair of conveying rollers 43, 43A in the conveying direction.

The conveying device 4 includes a large-diameter conveying roller 45, a curved guide surface 45Q and pinch rollers 45P, 45Q at the downward curved portion of the conveyance path P1. An outer circumferential surface of the conveying roller 45 serves as an inner guide surface of the downward curved portion of the conveyance path P1. The curved guide surface 45G is spaced apart from the outer circumferential surface of the conveying roller 45 at a predetermined distance therebetween. The curved guide surface 45G serves as an outer guide surface of the downward curved portion of the conveyance path P1. The conveying roller 45 cooperates with each of the pinch rollers 45P, 45Q contacting an outer circumferential surface of the conveying roller 45 to convey the sheet SH to the reading surface 82A.

The conveying device 4 includes a pressing member 49 disposed above and opposed to the reading surface 82A. The pressing member 49 presses an upper surface of the sheet SH conveyed from the conveying roller 45, to bring the sheet SH into contact with the reading surface 82A.

The conveying device 4 includes guide walls 47, 46 arranged to the right of the pressing member 49. The guide wall 47 defines, from below, a portion of the conveyance path P1 which is located to the right of the pressing member 49 and inclined upward. The guide wall 46 is located over the guide wall 47 to form a space between the guide wall 46 and the guide wall 47. The guide wall 46 defines, from above, the portion of the conveyance path P1 which is located to the right of the pressing member 49 and inclined upward.

The conveying device 4 further includes a discharge unit 48. The discharge unit 48 discharges the sheet SH from the conveyance path P1 onto the discharge tray 92. The discharge unit 48 includes two (front and rear) pairs of discharge rollers 48A and nip rollers 48B at the portion of the conveyance path P1 which is located to the right of the pressing member 49 and inclined upward.

The discharge rollers 48A and the nip rollers 48B face the discharge tray 92. The discharge rollers 48A are located near a right end of the guide wall 46. The nip rollers 48B are located near a right end of the guide wall 47. The nip rollers 48B are located under and opposed to the respective discharge rollers 48A so as to form a nip position N1. The discharge rollers 48A and the nip rollers 48B at the nip position N1 nip the sheet SH having passed through an area over the reading surface 82A and convey the sheet SH in a discharge direction D1 to discharge it onto the support surface 92A of the discharge tray 92.

Figure 5:
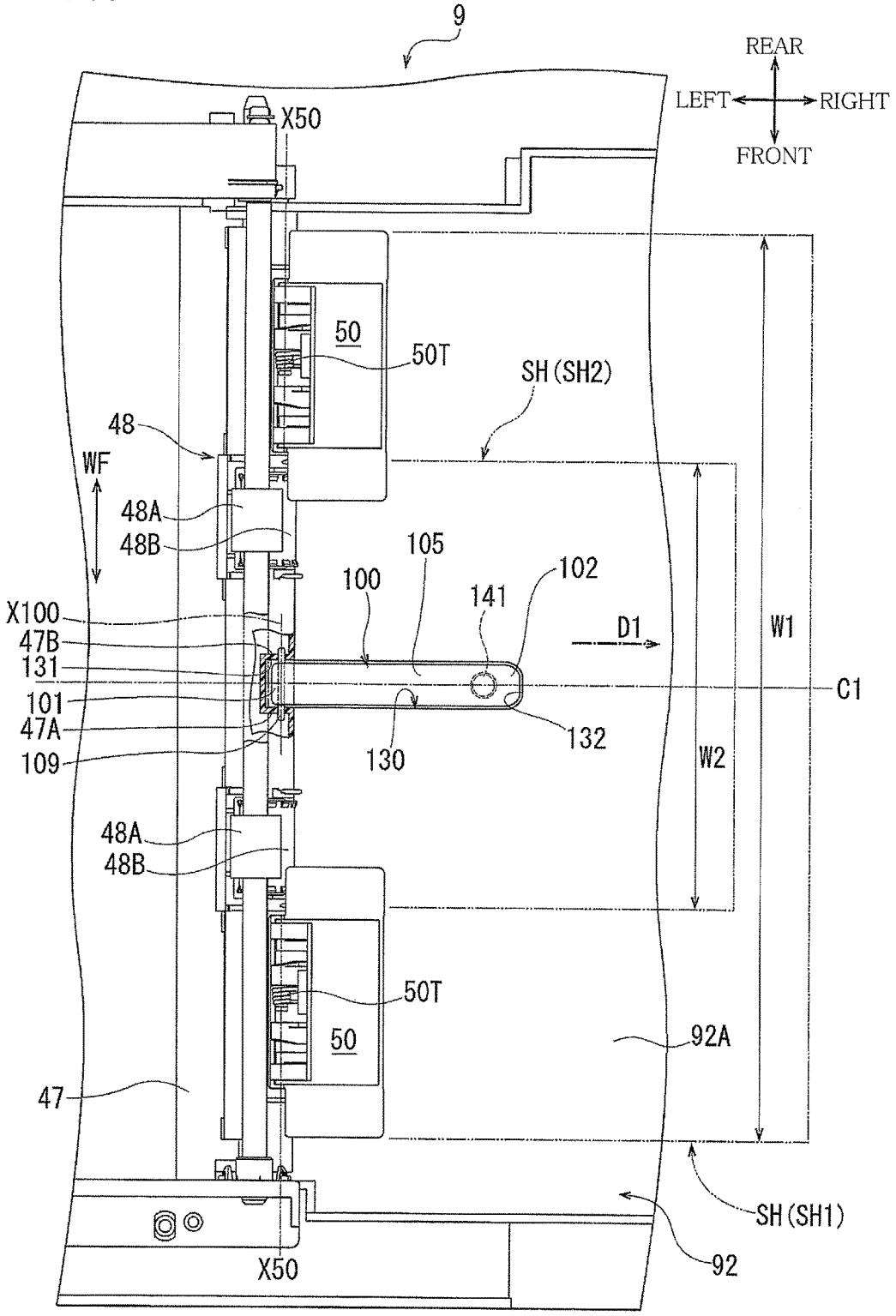
FIG. 5 is a top view illustrating a portion of the image reading apparatus which includes a discharge unit, a discharge tray, a projection, and pressing members.

As illustrated in FIG. 5, the widthwise direction WF coinciding with the front and rear direction is perpendicular to the discharge direction D1 directed rightward. As illustrated in FIG. 4, the discharge direction D1 is slightly inclined downward to the right. Thus, an imaginary line K1 extending in the discharge direction D1 through the nip position N1 intersects the support surface 92A of the discharge tray 92 which is inclined so as to be higher at its right portion than at its left portion. With this construction, the sheet SH discharged by the discharge rollers 48A and the nip rollers 48B is conveyed toward a downstream side in the discharge direction D1, with a leading edge portion of the sheet SH being moved toward the support surface 92A.

Figure 6:
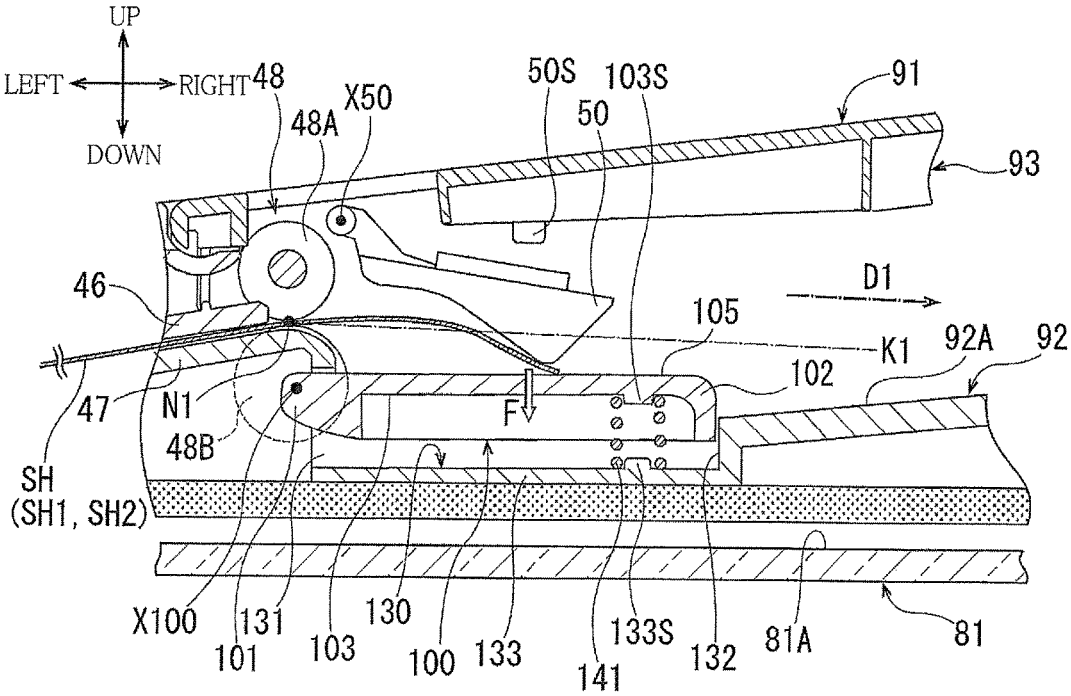
FIG. 6 is a fragmentary enlarged view in cross section illustrating a portion of the image recording apparatus which includes the discharge unit, the discharge tray, the projection, and the pressing members.

As illustrated in FIGS. 4-6, the discharge unit 48 includes a pair of front and rear pressing members 50. The pressing members 50 are provided downstream of the discharge rollers 48A and the nip rollers 48B in the discharge direction D1. Left end portions of the respective pressing members 50 are supported by an inside frame, not shown, in the opening and closing member 9 so as to be pivotable about a pivot axis X50. The pivot axis X50 is located above and to the right of the discharge rollers 48A and extends in the front and rear direction.

As illustrated in FIG. 5, torsion coil springs 50T are mounted on the respective pressing members 50. The torsion coil springs 50T urge the respective pressing members 50 in the clockwise direction in FIGS. 4 and 6 about the pivot axis X50. As a result, the pressing members 50 are urged such that their respective right end portions are to be moved toward the support surface 92A of the discharge tray 92.

As illustrated in FIG. 6, the sheet SH discharged by the discharge rollers 48A and the nip rollers 48B is conveyed toward a downstream side, i.e., the support surface 92A, in the discharge direction D1 while pressed by the pressing members 50.

As illustrated in FIGS. 4 and 6, contact portions 50S are provided on a lower surface of the chute 93. The contact portions 50S protrude downward and are located above the respective pressing members 50 so as to be spaced apart therefrom. In the case where the pressing members 50 are pivoted in the counterclockwise direction in FIG. 3 by pressing of the sheet SH being discharged, the contact portions 50S contact the respective pressing members 50 to prevent the pressing members 50 from moving away from the sheet SH.

Image Reading Operation

When the reading unit 3 reads an image recorded on a document supported on the document support surface 81A, the scanning mechanism, not shown, of the reading unit 3 reciprocates the reading sensor 3S in the right and left direction within an area extending from a position under a left edge of the document support surface 81A to a position under a right edge of the document support surface 81A. During this reciprocation, the reading sensor 3S reads the image recorded on the document supported on the document support surface 81A. Upon completion of the reading, the scanning mechanism, not shown, moves the reading sensor 3S a right end portion to a left end portion in the reading unit 3, so that the reading sensor 3S is moved back to its original position.

When the reading unit 3 reads an image recorded on the sheet SH placed on the supply tray 91, the scanning mechanism, not shown, of the reading unit 3 moves the reading sensor 3S to the stationary reading position located under the reading surface 82A. When the conveying device 4 thereafter conveys the sheets SH one by one from the supply tray 91 along the conveyance path P1, each sheet SH is conveyed through a position over the reading sensor 3S positioned at the stationary reading position, while contacting the reading surface 82A. During this conveyance, the reading sensor 3S reads an image recorded on the sheet SH passing through the position over the reading sensor 3S. After the image reading, as illustrated in FIGS. 6-9, the sheet SH is discharged onto the support surface 92A of the discharge tray 92 by the discharge rollers 48A and the nip rollers 48B.

FIG. 5 illustrates a relative positional relationship in the widthwise direction WF between the support surface 92A of the discharge tray 92 and each of the large sheet SH1 (e.g., the A4 sheet) and the small sheet SH2 (e.g., the A6 sheet) supported on the support surface 92A. A center line C1 of the support surface 92A extends in the right and left direction through a midpoint of the length W1 of the large sheet SH1 discharged on the support surface 92A in the widthwise direction WF and through a midpoint of the length W2 of the small sheet SH2 discharged on the support surface 92A in the widthwise direction WF. Thus, the sheets SH (including the sheets SH1 and SH2) discharged on the discharge tray 92 are supported on the support surface 92A with center alignment.

Construction of Projection

As illustrated in FIGS. 3-9, the support surface 92A of the discharge tray 92 is provided with the projection 100.

Specifically, the discharge tray 92 has a recess 130 which is recessed downward from the support surface 92A. The recess 130 is formed in a central portion of the support surface 92A in the widthwise direction WF so as to extend in the right and left direction, i.e., the discharge direction D1. Here, the central portion of the support surface 92A in the widthwise direction WF is located at a position through which the center line C1 of the support surface 92A extends.

As illustrated in FIG. 5, the recess 130 is a hole having a closed bottom and a rectangular shape elongated in the right and left direction in top view. As illustrated in FIGS. 5 and 6, a left end portion 131 of the recess 130 is located under the guide wall 47. Specifically, the left end portion 131 of the recess 130 is located under the nip position N1. A right end portion 132 of the recess 130 is located to the right of the pressing members 50, that is, the right end portion 132 is located downstream of the pressing members 50 in the discharge direction D1.

As illustrated in FIG. 5, a pair of walls 47A, 47B are provided under the guide wall 47 such that the left end portion 131 of the recess 130 is interposed between the pair of walls 47A, 47B in the widthwise direction WF. As illustrated in FIG. 6, a bottom wall 133 defining the recess 130 extends substantially horizontally in the right and left direction. The bottom wall 133 is provided with a spring holder 133S. The spring holder 133S protrudes upward from the bottom wall 133 at a position near the right end portion 132.

As illustrated in FIGS. 5 and 6, the projection 100 has a substantially rectangular parallelepiped shape elongated in the right and left direction. A lower portion of the projection 100 is located in the recess 130, and the projection 100 extends in the right and left direction and protrudes upward to a position above the support surface 92A. An upstream edge 101 of the projection 100 in the discharge direction D1 is located near the left end portion 131 of the recess 130 in the right and left direction. A downstream edge 102 of the projection 100 in the discharge direction D1 is located near the right end portion 132 of the recess 130 in the right and left direction.

That is, as illustrated in FIG. 5, the projection 100 is located at the central portion of the support surface 92A in the widthwise direction WF and extends in the discharge direction D1. The pair of pressing members 50 are located upstream of the downstream edge 102 of the projection 100 in the discharge direction D1. The projection 100 is interposed between the pair of pressing members 50 in the widthwise direction WF.

As illustrated in FIG. 6, an upper end portion 105 of the projection 100 has a flat surface (as one example of a pressing surface) extending smoothly from a position near the upstream edge 101 to a position near the downstream edge 102. The projection 100 has a recessed portion 103 which is recessed upward from a lower surface of the projection 100. A spring holder 103S is provided in the recessed portion 103. The spring holder 103S protrudes downward from an upper inner wall surface of the recessed portion 103 at a position near the downstream edge 102. It is noted that, as will be described below, the flat surface formed on the upper end portion 105 of the projection 100 serves as a surface which receives a pressing force from the sheet SH discharged from the discharge unit 48, e.g., a downward pressing force F illustrated in FIG. 6.

Figure 7:
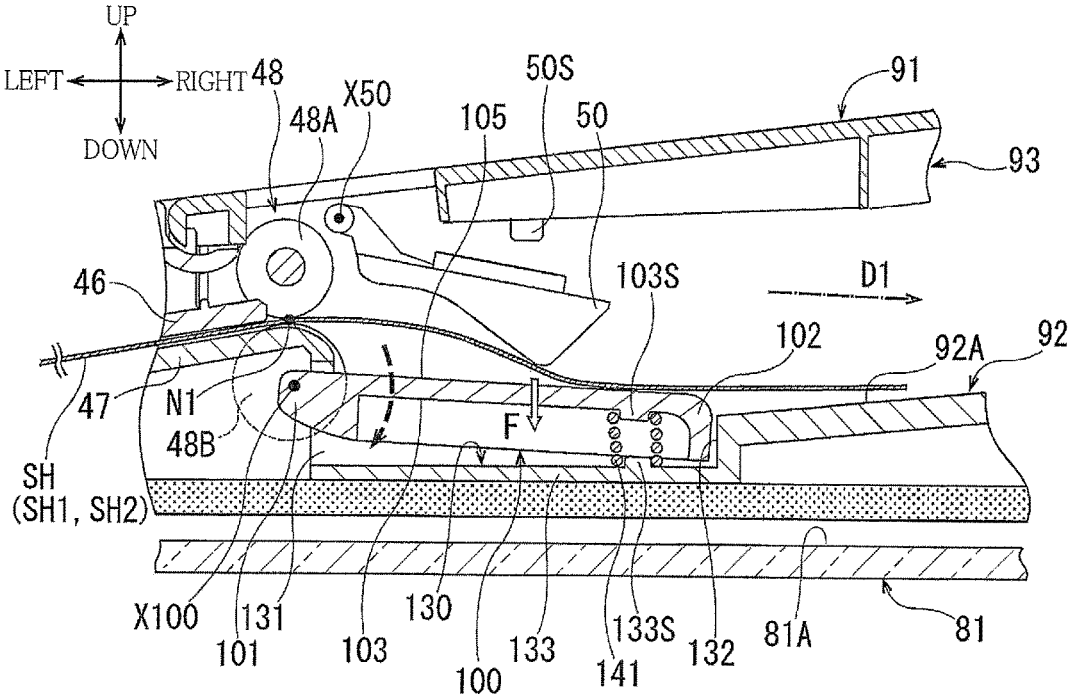
FIG. 7 is a fragmentary enlarged view in cross section illustrating a portion of the image recording apparatus which includes the discharge unit, the discharge tray, the projection, and the pressing members.

As illustrated in FIG. 5, a circular cylindrical shaft 109 rotatable about a pivot axis X100 is inserted in the projection 100 at a position near the upstream edge 101. The pivot axis X100 extending in the widthwise direction WF is located under the nip position N1 and upstream of the downstream edge 102 in the discharge direction D1. Opposite end portions of the circular cylindrical shaft 109 are pivotably supported by the respective walls 47A, 47B provided on the guide wall 47. With this construction, as illustrated in FIGS. 6 and 7, the projection 100 is supported by the discharge tray 92 so as to be pivotable about the pivot axis X100 such that the downstream edge 102 is moved upward and downward. That is, the entire projection 100 forms a movable portion in the present embodiment.

A compression coil spring 141 is provided between the projection 100 and the recess 130. A lower end of the compression coil spring 141 is held by the spring holder 133S in the recess 130. An upper end of the compression coil spring 141 is held by the spring holder 103S provided in the recessed portion 103 formed in the projection 100. The spring holder 103S and the spring holder 133S are opposed to each other, and the compression coil spring 141 urges a portion of the projection 100 near the downstream edge 102 upward.

Figure 8A:
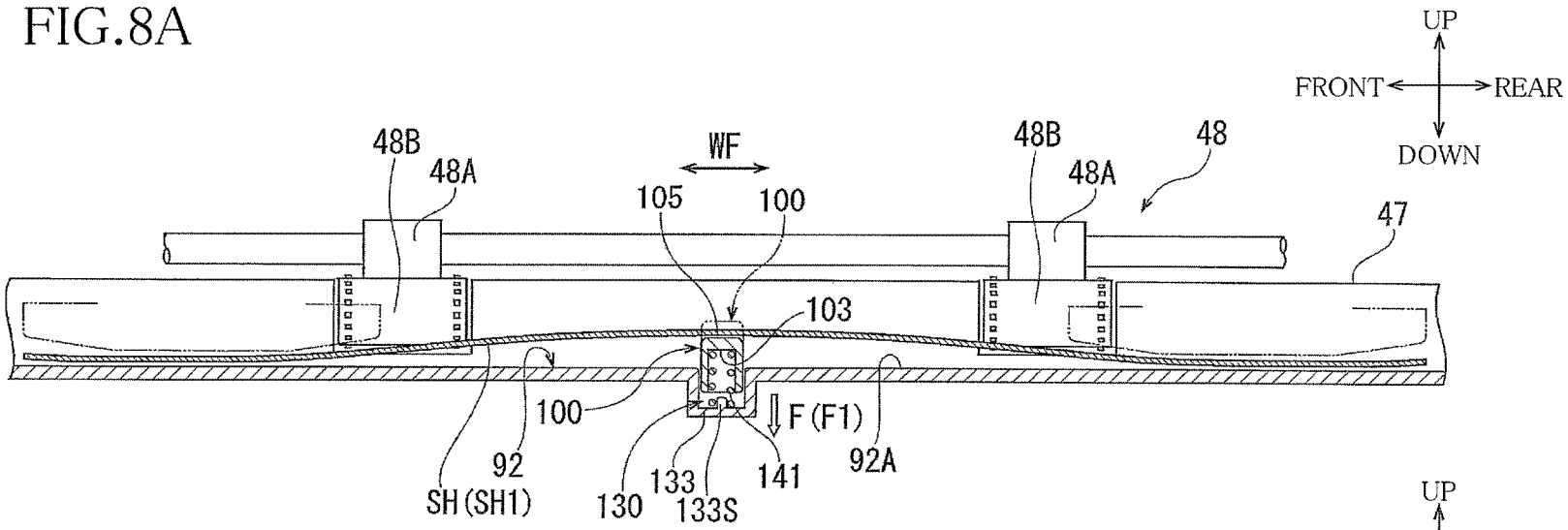
FIGS. 8A and 8B are partial cross-sectional views illustrating the discharge unit, the discharge tray, the projection, the pressing members, and other components when these elements are viewed from downstream side in an output direction.
Figure 8B:
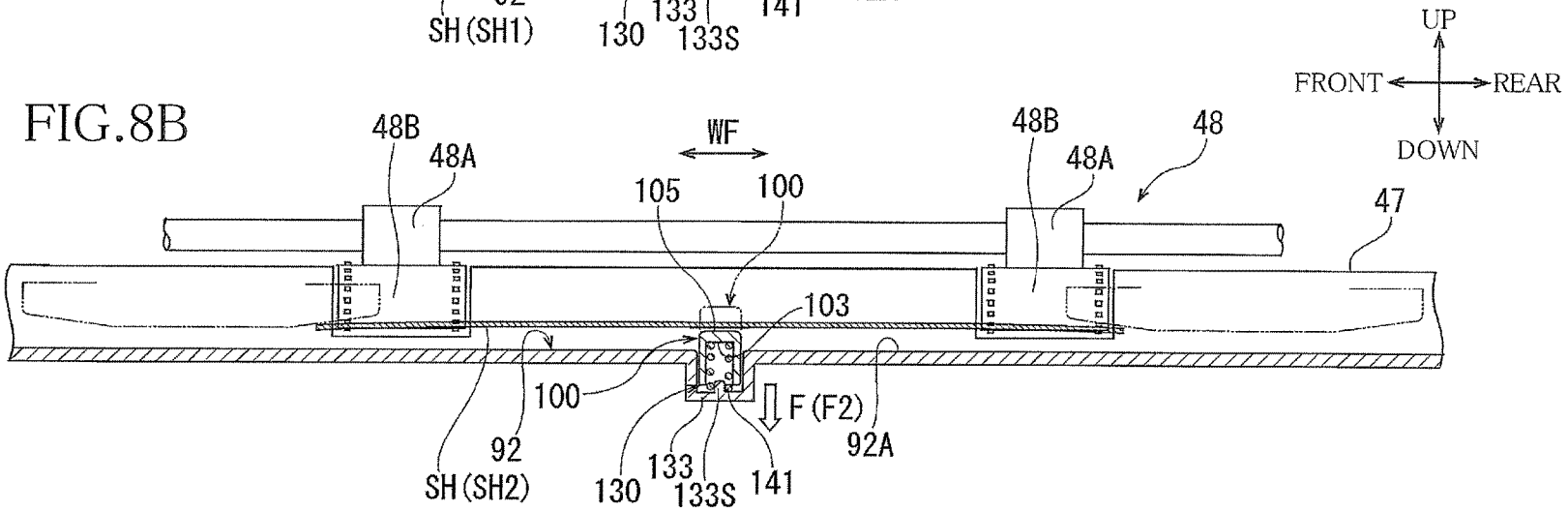
Figure 9:
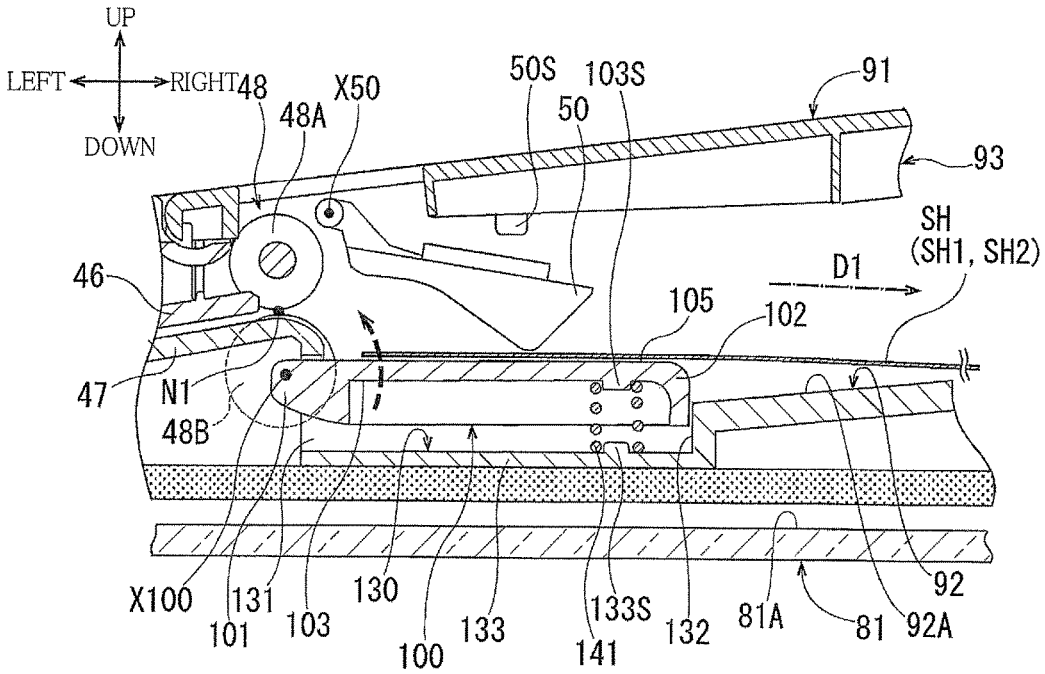
FIG. 9 is a fragmentary enlarged view in cross section illustrating a portion of the image recording apparatus which includes the discharge unit, the discharge tray, the projection, and the pressing members.

The projection 100 illustrated in FIGS. 6 and 9 is located at a first position at which the upper end portion 105 of the projection 100 is spaced apart from the support surface 92A in the greatest degree in a state in which the portion of the projection 100 near the downstream edge 102 is located at its uppermost position. The projection 100 indicated by the two-dot chain lines in FIGS. 8A and 8B is also located at the first position. The upper end portion 105 extends substantially horizontally in the right and left direction in the state in which the projection 100 is located at the first position. The compression coil spring 141 urges the projection 100 so as to keep the projection 100 at the first position. It is noted that, as illustrated in FIG. 6, a position at which the pair of pressing members 50 press the sheet SH is located below the nip position N1. Thus, the sheet SH being discharged from the discharge unit 48 is conveyed obliquely downward while being pressed by the pair of pressing members 50. Also, the upper end portion 105 of the projection 100 (the flat surface of the upper end portion 105) is located below the nip position N1 in the state in which the projection 100 is located at the first position. Thus, a leading edge of the sheet SH pressed obliquely downward by the pair of pressing members 50 (i.e., a downstream edge of the sheet SH in the discharge direction) is conveyed obliquely downward and brought into contact with the upper end portion 105 of the projection 100 (specifically, the flat surface of the upper end portion 105), so that the downward pressing force F acts on the projection 100.

The projection 100 illustrated in FIG. 7 is located at a second position at which the portion of the projection 100 near the downstream edge 102 is located below the its uppermost position, the projection 100 is partially located in the recess 130, and the upper end portion 105 of the projection 100 is nearer to the support surface 92A than the upper end portion 105 of the projection 100 located at the first position illustrated in FIGS. 6 and 9. The projection 100 indicated by the solid lines in FIGS. 8A and 8B is also located at the second position. The upper end portion 105 is inclined so as to be lower at its downstream portion than at its upstream portion in the discharge direction D1 in the state in which the projection 100 is located at the second position. As illustrated in FIG. 7, the upper end portion 105 of the downstream edge 102 is located above an upstream end of the support surface 92A in the discharge direction D1 also in the state in which the projection 100 is located at the second position.

The projection 100 is pivoted toward the second position when the upper end portion 105 receives a pressing force, e.g., the downward pressing force F illustrated in FIG. 6. In this movement, the compression coil spring 141 is compressed, resulting in increase in resilience force. The compression coil spring 141 is compressed within a certain range in length, and the second position of the projection 100 also changes within a particular range. That is, the second position of the projection 100 illustrated in FIGS. 7 and 8 is one example.

Operations and Effects

In the image reading apparatus 1 according to the first embodiment, examples of the sheets SH to be discharged onto the support surface 92A by the discharge rollers 48A and the nip rollers 48B include thin sheets which are easily bent and thick sheets which are not easily bent. In the following description, it is assumed that the large sheets SH1 are thin copy sheets and letter sheets which are easily bent, and the small sheets SH2 are thick postcard sheets and cards which are not easily bent, for example. In some case, in reality, the large sheet SH1 is a thick drawing sheet not easily bent, and the small sheet SH2 is a thin scratch sheet easily bent. This applies to sheets SH of sizes between the size of the large sheet SH1 and the size of the small sheet SH2. However, the projection 100 performs the same operations even in these cases, and an explanation of which is dispensed with.

In the image reading apparatus 1, as illustrated in FIG. 5, in the case where each of the thin easily-bent large sheet SH1 and the thick not-easily-bent small sheet SH2 is discharged onto the support surface 91A by the discharge rollers 48A and the nip rollers 48B, as illustrated in FIGS. 8A and 8B, the upper end portion 105 of the projection 100 raises a central portion of the sheet in the widthwise direction WF to curve the sheet, resulting in increase in resilience of the sheet.

In this operation, as illustrated in FIG. 6, the sheet is conveyed along the imaginary line K1 toward a downstream side in the discharge direction D1, with a leading edge of the sheet being moved toward the support surface 92A. Also, the sheet is conveyed toward a downstream side in the discharge direction D1, with the sheet being pressed onto the support surface 92A by the pressing members 50. As a result, the sheet is conveyed toward a downstream side in the discharge direction D1, with its leading edge portion being pressed onto the support surface 92A. Thus, the downward pressing force F acts on the upper end portion 105 of the projection 100 from each of the sheets SH1, SH2.

Here, since the sheet SH1 is thin and easily bent, in the case where the large sheet SH1 is discharged onto the support surface 92A, as illustrated in FIG. 8A, a relatively small pressing force F1 acts as the pressing force F on the upper end portion 105 of the projection 100 from the sheet SH1. When the sheet SH1 presses the upper end portion 105 of the projection 100 in the down direction, the compression coil spring 141 is compressed by the pressing force F1, so that the projection 100 is pivoted from the first position to the second position so as to move to a position nearer to the support surface 92A than the first position. As illustrated in FIG. 7, this operation reduces impact upon contact of the sheet SH1 with the upper end portion 105 of the projection 100, making it difficult for the sheet SH1 to be folded. This reduces a possibility of occurrence of malfunctions such as a crease in the thin easily-bent large sheet SH1 and generation of abnormal sounds when the sheet SH1 is folded.

Since the sheet SH2 is thick and not easily bent, in the case where the small sheet SH2 is discharged onto the support surface 92A, as illustrated in FIG. 8B, a pressing force F2 greater than the pressing force F1 acts as the pressing force F on the upper end portion 105 of the projection 100 from the sheet SH2. When the sheet SH2 presses the upper end portion 105 of the projection 100 in the down direction, the compression coil spring 141 is compressed by the pressing force F2, so that the projection 100 is pivoted from the first position to the second position so as to move to a position nearer to the support surface 92A than the first position. The second position of the projection 100 in this case is located below the second position of the projection 100 illustrated in FIG. 8A. As a result, as illustrated in FIG. 7, the sheet SH2 is less rubbed against the upper end portion 105 of the projection 100, making it difficult for a large resistance force to act on the sheet SH2 during conveyance.

As a result, it is possible to reduce a possibility of occurrence of malfunctions such as jam of each of the sheets SH1, SH2 due to hindrance to its discharge and generation of abnormal sounds due to friction between each of the sheets SH1, SH2 and the upper end portion 105 of the projection 100.

As illustrated in FIG. 9, when the discharge rollers 48A and the nip rollers 48B cease nipping each of the sheets SH1, SH2, the pressing force F ceases acting on the upper end portion 105 of the projection 100. Thus, the resilience force of the compression coil spring 141 pivots the projection 100 from the second position back to the first position. In this state, the upper end portion 105 of the projection 100 pivoted back to the first position reliably raises the central portion of each of the sheets SH1, SH2 in the widthwise direction WF on the support surface 92A to curve the sheet reliably, resulting in increase in resilience of the sheet.

Accordingly, the image reading apparatus 1 according to the first embodiment stably discharges the sheets SH having different properties onto the discharge tray 92.

In this image reading apparatus 1, as illustrated in, e.g., FIGS. 5 and 6, the entire projection 100 forms the movable portion. Thus, even in the case where the sheet SH being discharged onto the support surface 92A is brought into contact with any portion of the upper end portion 105 of the projection 100, the projection 100 is pivoted toward the second position. Accordingly, the image reading apparatus 1 is capable of more stably discharging various types of sheets SH having different sizes and properties, onto the discharge tray 92.

In this image reading apparatus 1, as illustrated in, e.g., FIGS. 5 and 6, the projection 100 is supported pivotably about the pivot axis X100 extending in the widthwise direction WF at a position located upstream of the downstream edge 102 in the discharge direction D1. The projection 100 is moved toward the second position by being pivoted about the pivot axis X100 such that the downstream edge 102 moves toward the support surface 92A. This simple construction allows the projection 100 to be easily pivoted from the first position to the second position. Also, as illustrated in FIG. 7, the upper end portion 105 is inclined with respect to the support surface 92A by a large angle in the state in which the projection 100 is located at the second position. This inclination facilitates sliding of the sheet SH during its contact with the upper end portion 105, enabling smooth discharge of the sheet SH.

In this image reading apparatus 1, as illustrated in FIG. 9, the compression coil spring 141 reliably pivots the projection 100 from the second position back to the first position.

In this image reading apparatus 1, as illustrated in FIG. 7, the downstream edge 102 of the projection 100 is located above the support surface 92A in the state in which the projection 100 is located at the second position, resulting in no inverse step between the downstream edge 102 and the support surface 92A in the discharge direction D1. Thus, the sheet SH being discharged onto the support surface 92A passes through the downstream edge 102 of the projection 100 without being caught by a step between the downstream edge 102 and the support surface 92A.

In this image reading apparatus 1, as illustrated in FIG. 4, the imaginary line K1 extending in the discharge direction D1 through the nip position N1 between the discharge rollers 48A and the nip rollers 48B intersects the support surface 92A. With this construction, as illustrated in FIGS. 6 and 7, the sheet SH is discharged by the discharge rollers 48A and the nip rollers 48B so as to move toward the support surface 92A, facilitating contact of the sheet SH with the upper end portion 105 of the projection 100, resulting in reliable achievement of the effects in this image reading apparatus 1.

In this image reading apparatus 1, as illustrated in FIGS. 5 and 6, the discharge unit 48 includes the pair of pressing members 50 located upstream of the downstream edge 102 of the projection 100 in the discharge direction D1 and configured to press the sheet SH being discharged in the discharge direction D1, onto the support surface 92A. The pressing members 50 are located on opposite sides of the projection 100 in the widthwise direction WF. With this construction, as illustrated in FIGS. 8A and 8B, the sheet SH being discharged onto the support surface 92A is pressed at its opposite edge portions in the widthwise direction WF by the pair of pressing members 50 and is brought at its central portion in the widthwise direction WF into contact with the upper end portion 105 of the projection 100 so as to be curved, resulting in reliable achievement of the effects in this image reading apparatus 1.

In this image reading apparatus 1, the discharge tray 92 has the recess 130 in which the projection 100 is located at the second position. This construction increases a distance of movement of the projection 100 from the first position to the second position, resulting in reliable reduction in impact upon contact of the sheet SH being discharged, with the upper end portion 105 of the projection 100.

Second Embodiment

Figure 10:
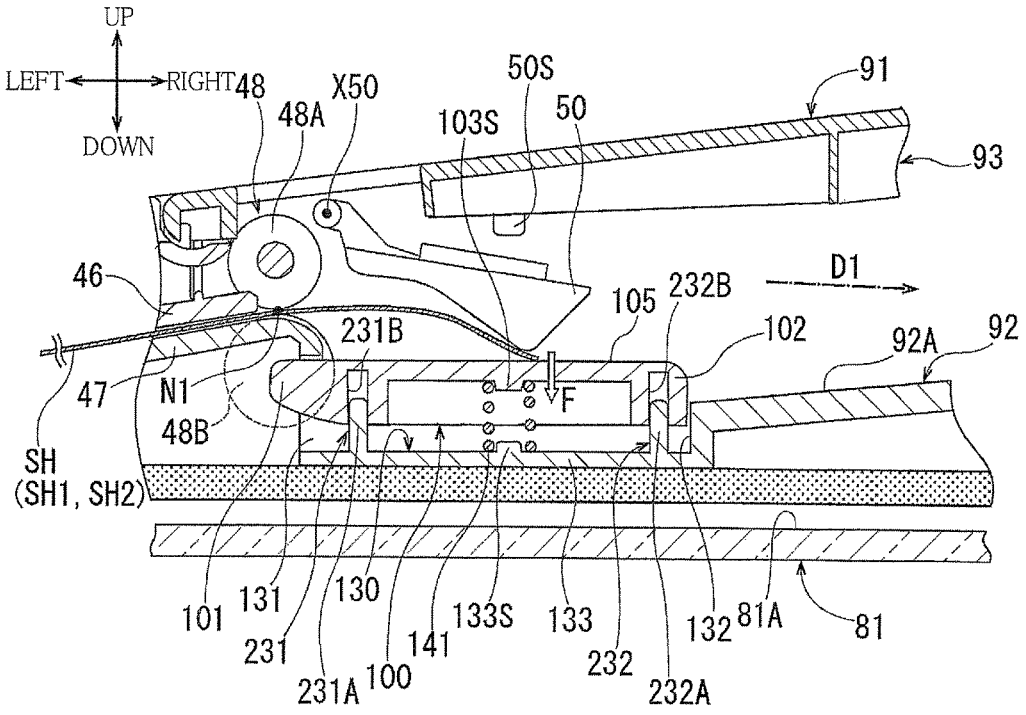
FIG. 10 is a fragmentary enlarged view in cross section illustrating a portion of an image recording apparatus according to a second embodiment, which portion includes the discharge unit, the discharge tray, a projection, and the pressing members.
Figure 11:
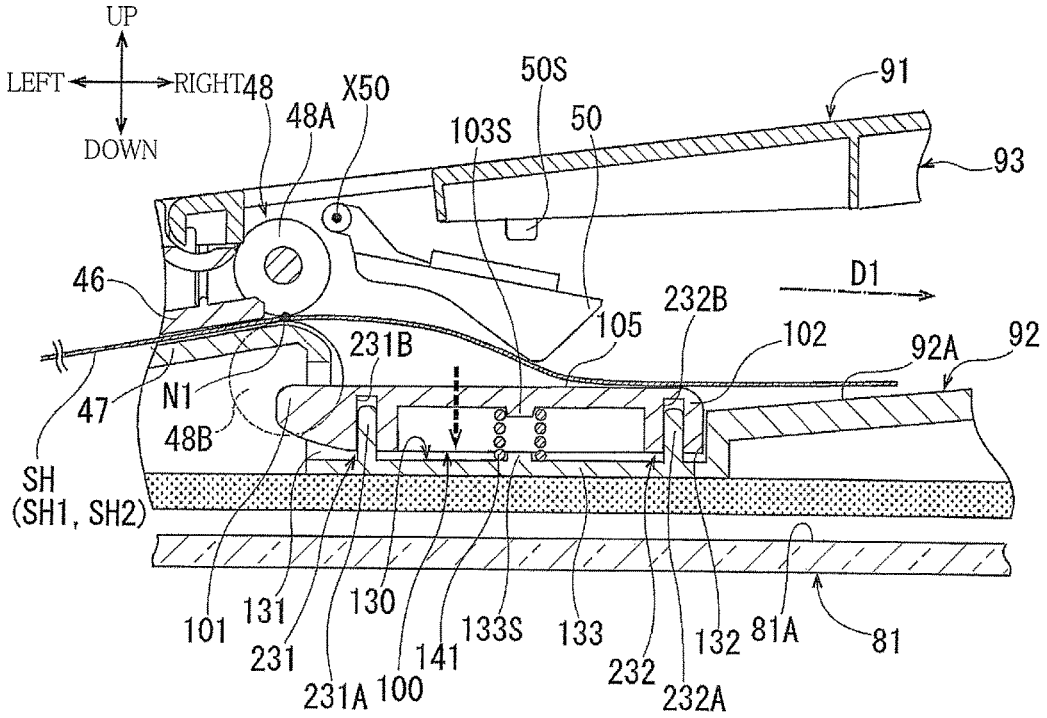
FIG. 11 is a fragmentary enlarged view in cross section illustrating the portion of the image recording apparatus according to the second embodiment, which portion includes the discharge unit, the discharge tray, the projection, and the pressing members.

As illustrated in FIGS. 10 and 11, an image reading apparatus according to the second embodiment does not include the circular cylindrical shaft 109 of the projection 100 in the first embodiment. Also, the spring holder 133S provided on the projection 100, the spring holder 103S provided in the recess 130, and the compression coil spring 141 are provided at a substantially intermediate portion of the recess 130 and the projection 100 in the right and left direction. Furthermore, a pair of linear-movement guides 231, 232 are provided on opposite sides of the recess 130 and the projection 100 in the right and left direction. Specifically, the linear-movement guide 231 is provided to the left of left ends of the recess 130 and the projection 100, and the linear-movement guide 232 is provided to the right of right ends of the recess 130 and the projection 100. The other constructions in the second embodiment are the same as those in the first embodiment. Thus, the same reference numerals as used in the first embodiment are used to designate the corresponding elements of the second embodiment, and an explanation of which is dispensed with.

The linear-movement guide 231 is constituted by a shaft 231A and a hole 231B, and the linear-movement guide 232 is constituted by a shaft 232A and a hole 232B. The pair of shafts 231A, 232A protrude upward from the bottom wall 133 defining the recess 130. The pair of holes 231B, 232B recessed upward from the lower surface of the projection 100. The pair of shafts 231A, 232A are slidably inserted in the respective holes 231B, 232B. The pair of linear-movement guides 231, 232 support the projection 100 so as to allow linear movement of the projection 100 in the up and down direction. Upon receiving a downward pressing force, the holes 231B, 232B are guided by the respective shafts 231A, 232A, whereby the projection 100 is translated downward from the first position illustrated in FIG. 10 toward the support surface 92A and positioned at the second position illustrated in FIG. 11. When the pressing force is canceled, on the other hand, the projection 100 located at the second position illustrated in FIG. 11 is translated so as to move away from the support surface 92A and returned to the first position illustrated in FIG. 10.

Like the image reading apparatus 1 according to the first embodiment, the image reading apparatus according to the second embodiment is capable of stably discharging the sheets SH having different properties, onto the discharge tray 92.

In this image reading apparatus, an inclination angle of the upper end portion 105 with respect to the support surface 92A is substantially the same between the first position and the second position of the projection 100. This construction reliably increases resilience of the sheet SH being discharged onto the support surface 92A.

Third Embodiment

Figure 12:
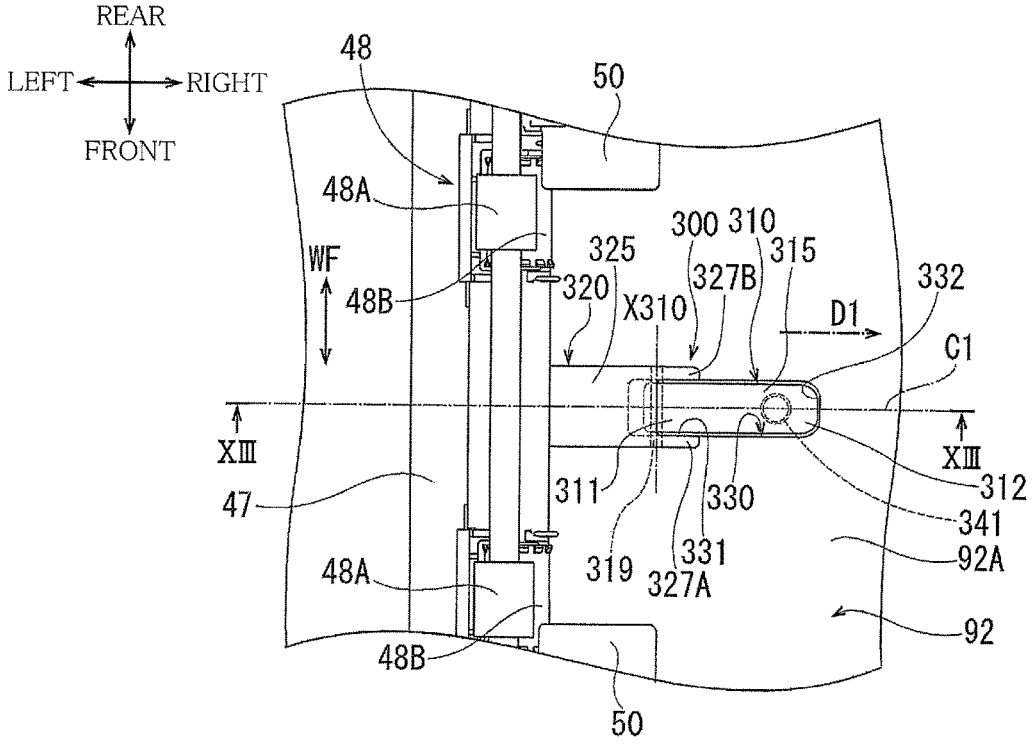
FIG. 12 is a top view illustrating a portion of an image reading apparatus according to a third embodiment, which portion includes the discharge unit, the discharge tray, and a projection.
Figure 13:
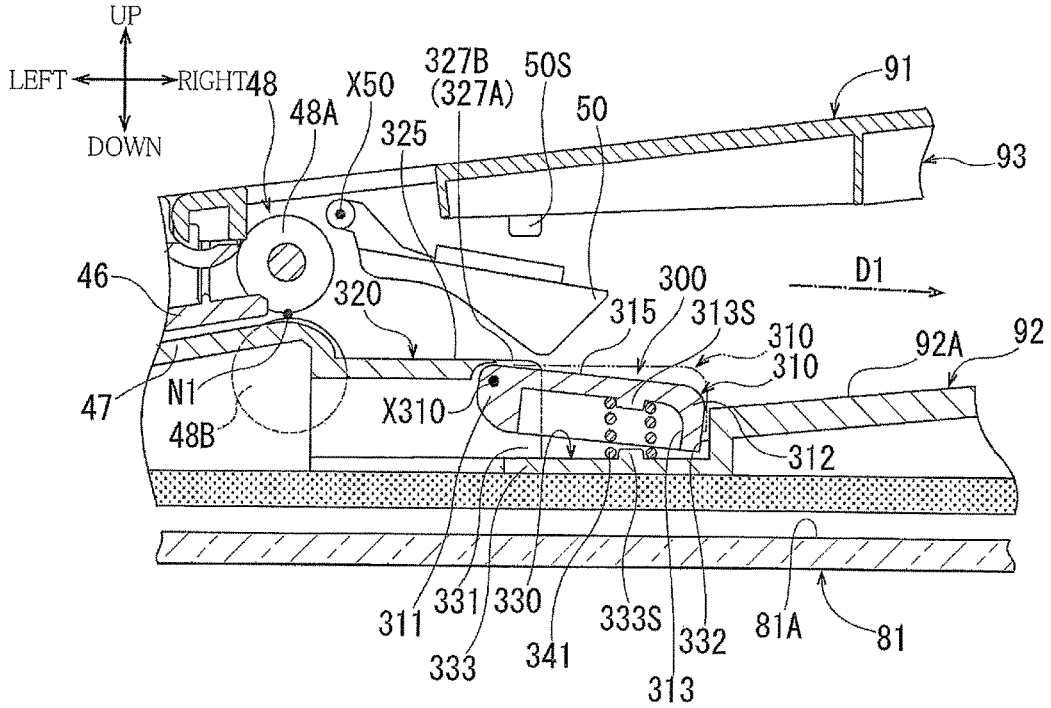
FIG. 13 is a fragmentary enlarged cross-sectional view taken along line XIII-XIII in FIG. 12.

As illustrated in FIGS. 12 and 13, an image reading apparatus according to the third embodiment includes a recess 330, a projection 300, and a compression coil spring 341 instead of the recess 130, the projection 100, and the compression coil spring 141 in the first embodiment. The other constructions in the third embodiment are the same as those in the first embodiment. Thus, the same reference numerals as used in the first embodiment are used to designate the corresponding elements of the third embodiment, and an explanation of which is dispensed with.

The discharge tray 92 has the recess 330 which is recessed downward from the support surface 92A. The recess 330 is formed in the central portion of the support surface 92A in the widthwise direction WF so as to extend in the right and left direction, i.e., the discharge direction D1.

As illustrated in FIG. 12, the recess 330 is a hole having a closed bottom and a rectangular shape elongated in the right and left direction in top view. A position of a right end portion 332 of the recess 330 illustrated in FIGS. 12 and 13 is substantially the same as that of the right end portion 132 of the recess 130 in the first embodiment illustrated in FIGS. 5 and 6. A left end portion 331 of the recess 330 illustrated in FIGS. 12 and 13 is located to the right of the left end portion 131 of the recess 130 in the first embodiment illustrated in FIGS. 5 and 6 and located downstream of the discharge unit 48 in the discharge direction D1, with a space between the left end portion 331 and the discharge unit 48. As illustrated in FIG. 13, a spring holder 333S is provided on a bottom wall 333 defining the recess 330. The spring holder 333S protrudes upward from the bottom wall 333 at a position near the right end portion 332.

As illustrated in FIGS. 12 and 13, the projection 300 includes a projection body 320 and a movable portion 310.

The projection body 320 is located at the central portion of the support surface 92A in the widthwise direction WF and extends in the right and left direction, i.e., the discharge direction D1. A left end portion of the projection body 320 is connected to the guide wall 47. A pair of walls 327A, 327B are provided on a right end portion of the projection body 320 such that the left end portion 331 of the recess 330 is interposed between the pair of walls 327A, 327B in the widthwise direction WF. An upper end portion 325 of the projection body 320 has a flat surface smoothly extending from the left end portion to the right end portion of the projection body 320.

The movable portion 310 has a substantially rectangular parallelepiped shape elongated in the right and left direction. A lower portion of the movable portion 310 is located in the recess 330, and the movable portion 310 extends in the right and left direction and protrudes upward to a position above the support surface 92A. An upstream edge 311 of the movable portion 310 in the discharge direction D1 is located near the left end portion 331 of the recess 330 in the right and left direction and interposed between the pair of walls 327A, 327B in the widthwise direction WF. A downstream edge 312 of the movable portion 310 in the discharge direction D1 is located near the right end portion 332 of the recess 330 in the right and left direction.

As illustrated in FIG. 13, an upper end portion 315 of the movable portion 310 has a flat surface extending smoothly from a position near the upstream edge 311 to a position near the downstream edge 312. The movable portion 310 has a recessed portion 313 which is recessed upward from a lower surface of the movable portion 310. A spring holder 313S is provided in the recessed portion 313. The spring holder 313S protrudes downward from an upper inner wall surface of the recessed portion 313 at a position near the downstream edge 312.

As illustrated in FIG. 12, a circular cylindrical shaft 319 rotatable about a pivot axis X310 is inserted in the movable portion 310 at a position near the upstream edge 311. Opposite end portions of the circular cylindrical shaft 319 are pivotably supported by the respective walls 327A, 327B. With this construction, as indicated by the two-dot chain line and the solid line in FIG. 13, the movable portion 310 is supported by the discharge tray 92 so as to be pivotable about the pivot axis X310.

The compression coil spring 341 is provided between the movable portion 310 and the recess 330. A lower end of the compression coil spring 341 is held by the spring holder 333S in the recess 330. An upper end of the compression coil spring 341 is held by the spring holder 313S provided on the movable portion 310. The compression coil spring 341 urges a portion of the movable portion 310 near the downstream edge 312 upward.

The movable portion 310 indicated by the two-dot chain line in FIG. 13 is located at a first position at which the upper end portion 315 of the movable portion 310 is spaced apart from the support surface 92A in the greatest degree in a state in which the portion of the movable portion 310 near the downstream edge 312 is located at its uppermost position. The compression coil spring 341 urges the movable portion 310 so as to keep the movable portion 310 at the first position.

The movable portion 310 indicated by the solid line in FIG. 13 is located at a second position at which the portion of the movable portion 310 near the downstream edge 312 is located below the uppermost position, the movable portion 310 is partially located in the recess 330, and the upper end portion 315 of the movable portion 310 is nearer to the support surface 92A than the upper end portion 315 of the movable portion 310 located at the first position. The upper end portion 315 is inclined so as to be lower at its downstream portion than at its upstream portion in the discharge direction D1 in the state in which the movable portion 310 is located at the second position. The downstream edge 312 is located above the upstream end of the support surface 92A in the discharge direction D1 also in the state in which the movable portion 310 is located at the second position.

The movable portion 310 is pivoted toward the second position when the upper end portion 315 receives a downward pressing force from the sheet SH being discharged. In this movement, the compression coil spring 341 is compressed, resulting in increase in resilience force. The compression coil spring 341 is compressed within a certain range in length, and the second position of the movable portion 310 also changes within a particular range. That is, the second position of the movable portion 310 indicated by the solid line in FIG. 13 is one example.

Like the image reading apparatuses 1 according to the first and second embodiments, the image reading apparatus according to the third embodiment is capable of stably discharging the sheets SH having different properties, onto the discharge tray 92.

Fourth Embodiment

Figure 14:
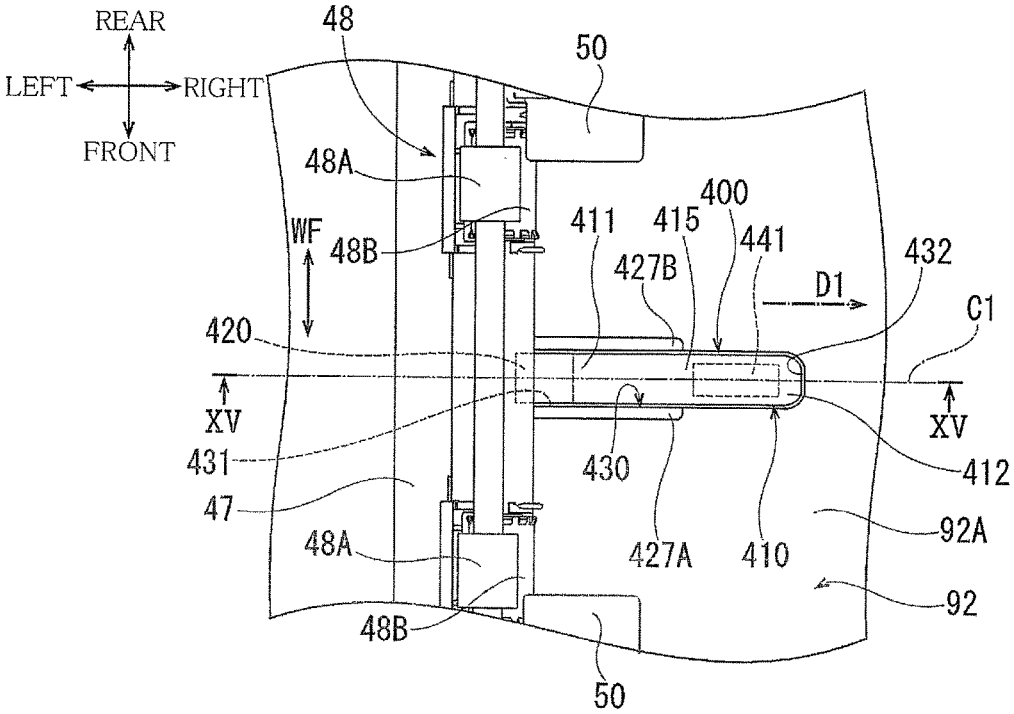
FIG. 14 is a top view illustrating a portion of an image reading apparatus according to a fourth embodiment, which portion includes the discharge unit, the discharge tray, and a projection.
Figure 15:
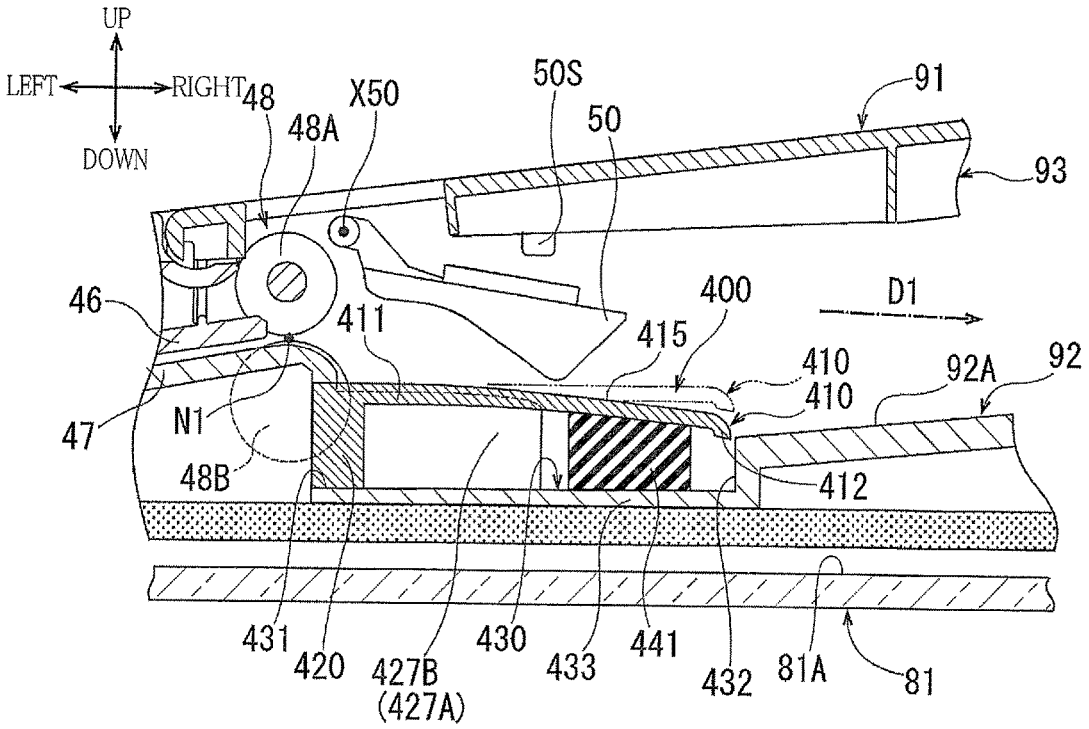
FIG. 15 is a fragmentary enlarged cross-sectional view taken along line XV-XV in FIG. 14.

As illustrated in FIGS. 14 and 15, an image reading apparatus according to the fourth embodiment includes a recess 430, a projection 400, and an elastic member 441 instead of the recess 130, the projection 100, and the compression coil spring 141 in the first embodiment. The other constructions in the fourth embodiment are the same as those in the first embodiment. Thus, the same reference numerals as used in the first embodiment are used to designate the corresponding elements of the fourth embodiment, and an explanation of which is dispensed with.

The discharge tray 92 has the recess 430 which is recessed downward from the support surface 92A. The recess 430 is located at the central portion of the support surface 92A in the widthwise direction WF and extends in the right and left direction, i.e., the discharge direction D1.

As illustrated in FIG. 14, the recess 430 is a hole having a closed bottom and a rectangular shape elongated in the right and left direction in top view. As illustrated in FIG. 15, a left end portion 431 of the recess 430 is located under the guide wall 47. A right end portion 432 of the recess 430 is located to the right of the pressing members 50, that is, the right end portion 432 is located downstream of the pressing members 50 in the discharge direction D1.

As illustrated in FIGS. 14 and 15, the projection 400 includes a pair of walls 427A, 427B, a base portion 420, and a movable portion 410.

As illustrated in FIG. 14, the pair of walls 427A, 427B are provided on the support surface 92A. The pair of walls 427A, 427B protrude upward and extend in the right and left direction. A portion of the recess 430 which is near the left end portion 431 in the widthwise direction WF is interposed between the pair of walls 427A, 427B. As illustrated in FIG. 15, a bottom wall 433 defining the recess 430 extends substantially horizontally in the right and left direction.

The base portion 420 and the movable portion 410 are molded in one piece and formed of a flexible material such as resin. The base portion 420 is shaped like a block and fixed and fitted between the left end portion 431 of the recess 430 and a lower portion of the guide wall 47.

An upstream edge 411 of the movable portion 410 in the discharge direction D1 is connected to an upper end portion of the base portion 420. As illustrated in FIG. 15, the movable portion 410 is located over and spaced apart from the support surface 92A and extends to a downstream side in the discharge direction D1 like a cantilever. A downstream edge 412 of the movable portion 410 in the discharge direction D1 is located near the right end portion 432 of the recess 430 in the right and left direction.

An upper end portion 415 of the movable portion 410 has a flat surface extending smoothly from a position near the upstream edge 411 toward a position near the downstream edge 412. As illustrated in FIGS. 14 and 15, a portion of the movable portion 410 which is near the upstream edge 411 is interposed between upper edges of the respective walls 427A, 427B in the widthwise direction WF.

The elastic member 441 is provided between the bottom wall 433 of the recess 430 and a portion of the movable portion 410 which is near the downstream edge 412. The elastic member 441 is formed of a material such as rubber, elastomer, and sponge. The elastic member 441 urges, in the up direction, the portion of the movable portion 410 which is near the downstream edge 412.

The movable portion 410 indicated by the two-dot chain line in FIG. 15 is located at a first position at which the upper end portion 415 of the movable portion 410 is spaced apart from the support surface 92A in the greatest degree in a state in which the portion of the movable portion 410 which is near the downstream edge 412 is located at its uppermost position. The elastic member 441 urges the movable portion 410 so as to keep the movable portion 410 at the first position.

The movable portion 410 indicated by the solid line in FIG. 15 is located at a second position at which the movable portion 410 is bent downward, the portion of the movable portion 410 which is near the downstream edge 412 is located below the uppermost position, and the upper end portion 415 of the movable portion 410 is nearer to the support surface 92A than the upper end portion 415 of the movable portion 410 located at the first position. The upper end portion 415 is inclined so as to be lower at its downstream portion than at its upstream portion in the discharge direction D1 in the state in which the movable portion 410 is located at the second position. The downstream edge 412 is located above the upstream end of the support surface 92A in the discharge direction D1 also in the state in which the movable portion 410 is located at the second position.

The position of the movable portion 410 is changed toward the second position when the upper end portion 415 receives a downward pressing force from the sheet SH being discharged. In this movement, the elastic member 441 is compressed, resulting in increase in resilience force. The elastic member 441 is compressed within a certain range in length, and the second position of the movable portion 410 also changes within a particular range. That is, the second position of the movable portion 410 indicated by the solid line in FIG. 15 is one example.

Like the image reading apparatuses 1 according to the first through third embodiments, the image reading apparatus according to the third embodiment is capable of stably discharging the sheets SH having different properties, onto the discharge tray 92.

While the embodiments have been described above, it is to be understood that the disclosure is not limited to the details of the illustrated embodiments, but may be embodied with various changes and modifications, which may occur to those skilled in the art, without departing from the spirit and scope of the disclosure.

For example, while the compression coil springs are used as the urging member in the above-described embodiments, various kinds of springs may be used as the urging member, such as a tension coil spring, a torsion coil spring, and a flat spring. Also, an elastic member, formed of a material such as rubber, elastomer, and sponge, may be used as the urging member.

For example, the bottom wall defining the recess 130 in the first embodiment may be removed and replaced with an opening. In this construction, a torsion coil spring is used instead of the compression coil spring 141 and disposed on the lower portion of the guide wall 47 so as to be coaxial with the pivot axis X100, for example. This construction allows the torsion coil spring to urge the projection 100 in the first embodiment toward the first position.

The projection is not limited to being located at the central portion of the support surface in the widthwise direction. Also, a plurality of projections may be provided on the support surface.

The present disclosure may be applied to image reading apparatuses, image forming apparatuses, and multi-function peripherals (MFPs), for example.

What is claimed is:

1. A sheet conveying apparatus, comprising:

a conveyor configured to convey a sheet along a conveyance path; and a discharge tray comprising a support surface configured to support the sheet discharged from the conveyor, the conveyor comprising a discharge unit constituting a portion of the conveyor and configured to discharge the sheet conveyed along the conveyance path, onto the discharge tray, the discharge tray comprising a projection protruding upward from the support surface, the projection being elongated in a direction along a discharge direction in which the sheet is conveyed by the conveyor, the projection comprising at least a portion comprising a downstream edge of the projection in the discharge direction, the at least the portion being a movable portion changeable in position between a first position at which an upper end portion of the projection is farthest from the support surface and a second position which is nearer to the support surface than the first position, wherein the discharge unit comprises a pair of rollers, wherein an upstream end portion of the projection in the discharge direction comprises a portion that overlaps the pair of rollers when viewed in a direction perpendicular to the discharge direction, wherein the discharge unit comprises a pair of pressing members provided upstream of the downstream edge in the discharge direction to press the sheet being discharged in the discharge direction, onto the support surface, wherein the projection is interposed between the pair of pressing members in a widthwise direction, and wherein the pair of pressing members are respectively urged by springs toward the support surface.

2. The sheet conveying apparatus according to claim 1, wherein the projection is disposed at a substantially central portion of the support surface in a widthwise direction perpendicular to the discharge direction.

3. The sheet conveying apparatus according to claim 1, wherein the position of the movable portion is changed from the first position toward the second position when the pressing force is received by the upper end portion of the projection.

4. The sheet conveying apparatus according to claim 3, wherein the upper end portion of the projection comprises a pressing surface configured to receive the pressing force from the sheet discharged by the discharge unit.

5. The sheet conveying apparatus according to claim 4, wherein a position at which the pair of pressing members press the sheet discharged is located below the nip position, and wherein the pressing surface of the projection is located below the nip position in a state in which the movable portion is located at the first position.

6. The sheet conveying apparatus according to claim 4, wherein the pressing surface is substantially parallel with a horizontal plane in a state in which the movable portion is located at the first position.

7. The sheet conveying apparatus according to claim 4, wherein the pressing surface is inclined so as to be lower at a downstream portion thereof than at an upstream portion thereof in the discharge direction in a state in which the movable portion is located at the second position.

8. The sheet conveying apparatus according to claim 1, wherein an entirety of the projection constitutes the movable portion.

9. The sheet conveying apparatus according to claim 1, wherein the movable portion is supported at a position located upstream of the downstream edge in the discharge direction such that the movable portion is pivotable about a pivot axis extending in the widthwise direction, and wherein the position of the movable portion is changed from the first position to the second position by being pivoted about the pivot axis such that the downstream edge is moved toward the support surface.

10. The sheet conveying apparatus according to claim 1, wherein the movable portion is supported so as to be movable linearly toward and away from the support surface, and the position of the movable portion is changed to the second position by being translated from the first position.

11. The sheet conveying apparatus according to claim 1, further comprising an urging member configured to urge the movable portion to keep the movable portion at the first position.

12. The sheet conveying apparatus according to claim 1, wherein the downstream edge of the movable portion is located above the support surface in a state in which the movable portion is located at the second position.

13. The sheet conveying apparatus according to claim 1, wherein an imaginary line extending in the discharge direction through the nip position intersects the support surface.

14. The sheet conveying apparatus according to claim 1, wherein the discharge tray comprises one of a recess and an opening in which at least a portion of the movable portion at the second position is located.

15. The sheet conveying apparatus according to claim 1, further comprising a reading device provided at an intermediate portion of the conveyance path and configured to read an image recorded on the sheet conveyed by the conveyor.

16. The sheet conveying apparatus according to claim 1, wherein the pair of pressing members are pivotable about an axis that is located above the pair of rollers and downstream of the pair of rollers in the discharge direction.

* * * * *